US007218886B2

(12) United States Patent
Hildebrand et al.

(10) Patent No.: US 7,218,886 B2
(45) Date of Patent: May 15, 2007

(54) METHOD AND KIT FOR REMOVING A RESIDUE FROM AN IMAGING MEMBER

(75) Inventors: Robert E. Hildebrand, Macedon, NY (US); Joseph M. Wing, Ontario, NY (US); Randall C. Ryon, Victor, NY (US); John R. Lambie, Ontario, NY (US); Moritz P. Wagner, Walworth, NY (US); Huoy-Jen Yuh, Pittsford, NY (US); Douglas A. Lundy, Webster, NY (US); Michael J. Turan, Walworth, NY (US); Eric Bonn, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 288 days.

(21) Appl. No.: 10/894,815

(22) Filed: Jul. 20, 2004

(65) Prior Publication Data

US 2006/0018689 A1 Jan. 26, 2006

(51) Int. Cl.
*G03G 21/00* (2006.01)
*G03G 15/20* (2006.01)

(52) U.S. Cl. ..... 399/343; 399/123; 430/125

(58) Field of Classification Search ..... 399/11, 399/71, 123, 343; 15/97.1, 100, 118; 430/125
See application file for complete search history.

(56) References Cited

U.S. PATENT DOCUMENTS 3,867,170 A * 2/1975 Ferguson et al. ..... 430/125
3,910,697 A * 10/1975 Lanker ..... 430/125
4,032,229 A * 6/1977 Tani et al. ..... 399/123 X
4,252,882 A * 2/1981 Herrmann ..... 430/125 X
5,069,128 A * 12/1991 Hara et al. ..... 399/343 X
RE34,437 E * 11/1993 Ariyama et al. ..... 399/343 X
5,359,398 A * 10/1994 Echigo et al. ..... 399/71
5,890,035 A 3/1999 Kumar et al.
6,144,834 A 11/2000 Thayer
6,253,047 B1 6/2001 Hildebrand et al.
6,347,212 B1 * 2/2002 Kosugi et al. ..... 399/343 X
6,351,621 B1 * 2/2002 Richards et al. ..... 399/111
6,361,913 B1 3/2002 Pai et al.
6,453,146 B1 9/2002 Yamada et al.
6,458,500 B1 10/2002 Zhao et al.
6,701,105 B2 3/2004 Funabashi
6,889,399 B2 * 5/2005 Steiner et al. ..... 8/159

* cited by examiner

*Primary Examiner*—Sandra L. Brase
(74) *Attorney, Agent, or Firm*—Eugene O. Palazzo; Fay Sharpe LLP

(57) ABSTRACT

A method for removing a residue, such as lateral charge migration (LCM) film, from an imaging member includes contacting at least a portion of the imaging member with a wash liquid capable of removing the residue. The wash liquid containing the residue is then removed, for example, by applying an absorbent material such as a toner, to the contacted portion of the imaging member.

13 Claims, 6 Drawing Sheets

METHOD AND KIT FOR REMOVING A RESIDUE FROM AN IMAGING MEMBER

BACKGROUND

The present disclosure relates to removal of deposits from a substrate, such as an imaging member. It finds particular application in conjunction with removal of a lateral charge migration film from a photoconductive receptor belt, and will be described with particular reference thereto. However, it is to be appreciated that the present disclosure is also amenable to other like applications.

In an electrophotographic application such as xerography, a charge retentive surface (i.e., photoconductor, photoreceptor, or imaging surface) is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner." Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. This process is known, and useful for light lens copying from an original, and printing applications from electronically generated or stored originals, where a charged surface may be image-wise discharged in a variety of ways. Ion projection devices where a charge is image-wise deposited on a charge retentive substrate operate similarly.

Electrophotographic imaging members are commonly multilayered photoreceptors that include a substrate support, an optional electrically conductive layer, an optional charge blocking layer, an optional adhesive layer, a charge generating layer, a charge transport layer, and an optional protective or overcoating layer(s). The imaging members can take several forms, including flexible belts, rigid drums, and the like.

Electrophotographic machines utilizing multilayered organic photoreceptors employ corotrons or scorotrons to charge the photoreceptors prior to exposure of an image. During the operating lifetime of photoreceptors, they are subjected to corona effluents which include ozone, various oxides of nitrogen, and the like. In the presence of volatile organic chemicals and water, a reaction occurs between the corona effluents. Over time, an electrically conductive film may develop on the photoreceptor belt.

Furthermore, during operation of the electrophotographic machine, a region of the top surface of the photoreceptor, such as a photoreceptor belt, is continuously worn away, thereby preventing or limiting accumulation of the conductive film. However, when the machine is not operating (i.e., in idle mode), for example, between two large copy runs, or at any time when the belt is moving but unprotected by toner, a conductive film can develop. In the idle mode, a portion of the photoreceptor comes to rest beneath a corotron. Although the high voltage to the corotron is turned off during the time period when the photoreceptor is stationary, some effluents (e.g. nitric acid, etc.) continue to be emitted from the corotron shield and corotron housing. This effluent emission is focused on the portion of the photoreceptor directly beneath the corotron, increasing the conductivity of the surface. When machine operation is resumed for the next copy run, image spreading and loss of resolution tends to occur in the region of the photoconductor where surface conductivity has increased, known as lateral charge migration (LCM). Deletion may also be observed in the loss of fine lines and details in the final print. Loss of resolution along the entire imaging surface can also occur due to an increase in surface conductance caused by corona species interaction. In the case of excessive increases in conductivity, there can be regions of extreme deletions in the images. This problem is particularly severe in devices employing arylamine charge transport molecules such as N,N'-diphenyl-N,N'-bis(3-methylphenyl)-(1,1'-biphenyl)-4,4'-diamine and charge transport polymers incorporating diamine transporting moieties.

The common solution to the problem of LCM deposits has been to replace the photoreceptor belt, resulting in down time of the imaging device.

U.S. Pat. No. 6,361,913 to Pai, et al. discloses a long life photoreceptor having improved resistance to corona effluent induced deletions. The photoreceptor comprises a substrate, a charge generating layer, a charge transport layer, and an overcoat layer. The overcoat layer comprises a hydroxy triphenyl methane having at least one hydroxy functional group and a polyamide film forming binder capable of forming hydrogen bonds with the hydroxy functional group. The charge transport layer is substantially free of triphenyl methane molecules.

There remains a need for a method of removal of residues, such as LCM films, from electrophotographic imaging members. Furthermore, there is a continuing need for an improved system for removing residues, such as those comprising morpholine derivation and/or the reaction products of corona effluents with volatile organic chemicals, from photoreceptors.

BRIEF DESCRIPTION

In accordance with one aspect of the present disclosure, a method for removing a residue, such as LCM film, from an imaging member is provided. The method includes contacting at least a portion of the imaging member with a wash liquid capable of removing the residue. The wash liquid containing the residue is then removed, for example, by applying an absorbent material such as a toner to the contacted portion of the imaging member. The imaging member may include a photoreceptor in the form of a continuous belt. Additionally, the wash liquid may include an aqueous solvent which is applied by an applicator such as a presoaked pad.

In accordance with a further aspect of the disclosure, a wash kit for removing residue from a substrate, such as an imaging member, is provided. The wash kit includes an application means such as an applicator or a pad and a wash liquid, carried by the pad. Means associated with the pad are provided for removably mounting the pad to an associated module capable of maintaining contact between the substrate and the pad. Packaging encloses the pad and wash liquid prior to use in a residue removal process. The residue may comprise reaction products of corona effluents with volatile organic chemicals, LCM films, etc.

In accordance with another aspect of the present disclosure, a method for cleaning a substrate, such as an imaging member, includes contacting the substrate with a wash liquid comprising water and a fugitive organic chemical such as an alcohol to remove morpholine deposit and, thereafter, contacting or applying to the substrate with an absorbent material. The applied absorbent material containing the wash liquid is then removed, such as with a cleaning agent.

Also disclosed herein is an imaging system comprising an imaging member, means for forming a latent image on the imaging member, means for transferring the latent image to a transfer material, means for driving the imaging member relative to the forming and transferring means, and a cleaning module capable of replacing at least a portion of the forming and transferring means. The cleaning module comprises a carrier material soaked with a wash liquid, whereby when the means for driving drives the imaging member, the wash liquid removes residue from the imaging member, the residue being formed during forming of a latent image. The means for forming a latent image may comprise at least one charging station for charging the imaging member prior to forming a latent image, at least a portion of the charging station being in the form of a removable module. The cleaning module may be configured for selectively replacing the module of the charging station or may be located at the image transfer location.

In a further embodiment, a method for cleaning a substrate surface contaminated with a morphaline deposit is also disclosed. The method comprises the step of contacting the substrate with water and an alcohol to remove morpholine deposit and, thereafter, contacting the substrate with a toner.

In accordance with another aspect of the present disclosure, a method for imaging is provided. The method comprises the steps of forming images on an imaging member, transferring the images to transfer media, the step of forming images resulting in residue forming a film on the imaging member which reduces the quality of the transferred image, contacting the imaging member with a wash liquid to remove residue, applying a toner composition to the imaging member to remove wash liquid and residue from the imaging member and, optionally, removing toner composition and associated wash liquid and residue with an electrostatic cleaner.

These and other non-limiting aspects of the disclosure are more particularly described below.

BRIEF DESCRIPTION OF THE DRAWINGS

The following is a brief description of the drawings, which are presented for the purposes of illustrating the disclosure set forth herein and not for the purposes of limiting the same.

DETAILED DESCRIPTION

Figure 1:
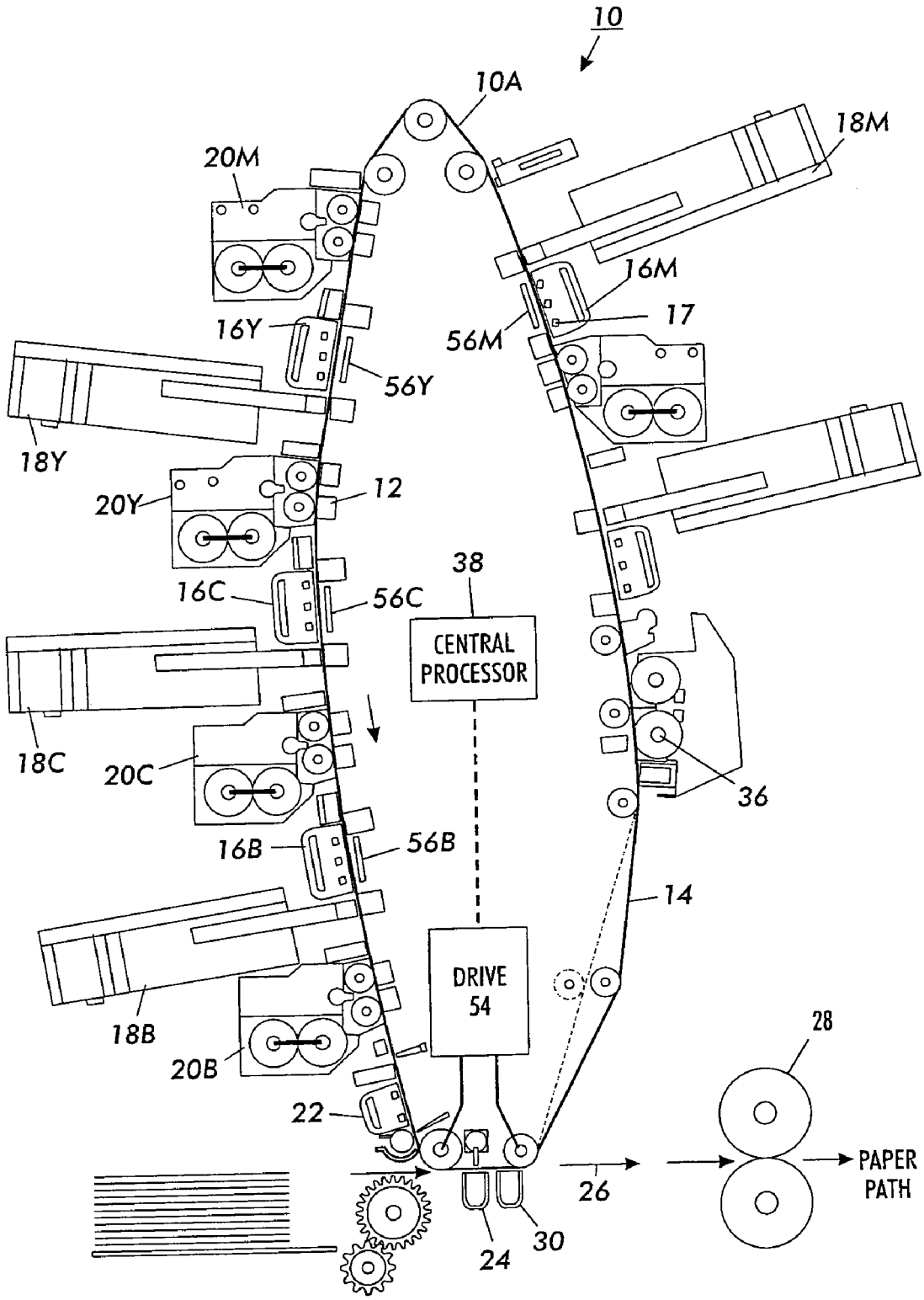
FIG. 1 PRIOR ART
FIG. 1 is a schematic view of a conventional imaging system according to the present disclosure.

The present disclosure is directed to a method for removing a residue from a substrate, such as an imaging member. The method comprises contacting at least a portion of the imaging member with a wash liquid capable of removing the residue and removing the wash liquid contaminated with the residue, for example, by applying a toner to the contacted portion of the imaging member. In this regard, the imaging member may include a photoreceptor in the form of a continuous belt. The wash liquid may include an aqueous solvent, such as water and/or an alcohol, such as isopropyl alcohol. The wash liquid may be carried on a presoaked pad. Among other characteristics, the method increases the lifetime of a photoreceptor belt.

The present application is also directed to a system for removing a residue from an imaging member. The system includes a pad soaked in a wash liquid and means for mounting the pad to a photoreceptor belt.

A more complete understanding of the processes and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to component of like function.

With reference to FIG. 1, an exemplary imaging device is shown. The device can be a reprographic device, a printer, or the like. In electronic printers, information forming documents to be printed are provided in electronic form to the printer. This electronic information can come from many sources, including, for example, a scanner, created by a software program, retrieved from a storage medium, or supplied from a computer or computer network.

The imaging device includes a charge retentive surface, such as a photoconductor, photoreceptor, or imaging surface. In the illustrated embodiment, a photoreceptor 10 comprises a continuous belt supported on rollers 12. The photoreceptor belt 10A has a charge retentive surface 14. At least one charging station is disposed adjacent the photoreceptor belt for charging the surface 14 of the photoreceptor belt 10A. The charging station may include a corotron or dicorotron corona generating device. For a single color imaging device, a single charging station is used.

FIG. 1 illustrates an imaging system made up of four color separations, magenta, yellow, cyan, and black, each color having its own charging station 16M, 16Y, 16C and 16B respectively arranged at spaced locations around the belt. In one embodiment, at least a portion of one of the charging system is in the form of a removable module 17.

A power source (not shown) applies a voltage on the charging station 16M, 16Y, 16C, 16B. An image input device (latent image forming unit) 18M, 18Y, 18C, 18B forms a latent image on the surface of the photoreceptor belt 10A. A developing station 20M, 20Y, 20C, 20B is associated with each charging station for developing the latent image formed on the surface of the photoreceptor belt 10A by applying a toner to obtain a toner image. A pretransfer charging unit 22 charges the developed latent image. A transferring unit 24 transfers the toner image thus formed to the surface of a transfer material (illustrated by path 26), such as a sheet of paper. The pretransfer charging unit 22 includes a corona generating device which charges the photoreceptor belt 10A so that the transfer material is tacked to the belt and the toner powder image is attracted from photoreceptor belt 10A to the transfer material. A fixing device 28 fixes the toner image transferred to the surface of the transfer material 26 by heat and/or pressure to form a copy or print. In one embodiment, a combination of electrostatic charges, sound waves and pressure move the dry toner down to the paper's surface, transferring the complete image in one step.

Figure 2:
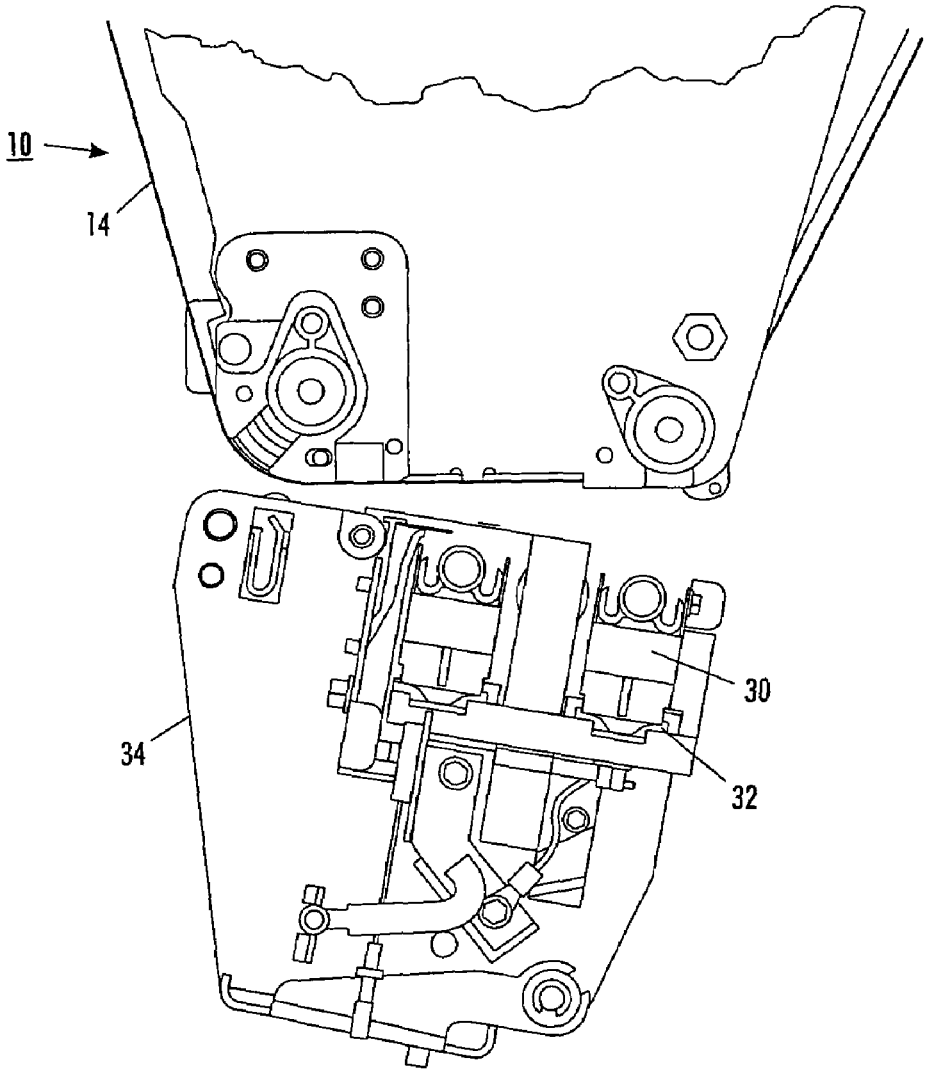
FIG. 2 is an enlarged side sectional view of a lower end of the photoreceptor belt and transfer deck of FIG. 1.

After transfer, a transfer detack corona generator 30, such as a corotron or dicorotron, charges the transfer material with an opposite polarity to detack the transfer material from the belt. As illustrated in FIG. 2, the dicorotron 30 is in the form of a removable module which is carried in a socket 32 of a transfer deck 34. The transfer deck is docked at a lower end of the photoreceptor belt and is pivotable between an upper position in which the dicorotron is adjacent the unprinted surface of the paper and a lower position (FIG. 2), in which the dicorotron is well spaced from the paper path to allow access for servicing and clearance of paper jams.

A cleaning unit 36 (FIG. 1) removes remaining toner from the surface 14 of the photoreceptor belt 10A. The operation of the imaging device is under the control of a central processor 38. The central processor receives inputs, such as manual inputs from a keypad, not shown, or instructions from a processor of a computer which is linked to the imaging device, and controls the various components of the imaging device to generate prints on the passing substrate.

Over time, LCM film may develop on the surface 14 of the photoreceptor belt 10A. The LCM film may be a continuous layer on the photoreceptor surface or discontinuous. The LCM film generally comprises a build up of water soluble conductive salts on the photoreceptor surface, such as those derived from morpholine and other organic amines. While the chemical processes involved with the buildup are not of particular relevance here, the salts are believed to be formed by reaction of nitrogen oxides and ozone in the charging stations with environmental air contaminants, such as volatile organic chemicals, and chemicals from the belt itself. For example, nitrous oxide from the corona discharge reacts with water to form nitric acid, which reacts with ammonia, morpholine, or other basic substances present on or near the belt. The reaction produces a salt, which forms a film on the belt. The salt is conductive in the presence of water. Morpholine is sometimes present when it is used as an additive in forming the charge transport layer of a photoreceptor belt. Ammonia may be present as an air contaminant. Morpholine-derived salts tend to be more conductive than ammonia-derived salts, such as ammonium nitrate. The LCM film containing the conductive salt may also contain other components, such as oils.

The salt film is not readily visible to the naked eye, but appears as an artifact on the print. Specifically, the salt in the LCM film creates a discharge path in the non-image areas of a latent image. Areas of the belt surface that have been discharged in this way tend to encourage charge migration from surrounding non-discharged areas. This may cause the potential in these surrounding areas to fall below the threshold and start to develop toner in the imaging process. The crisp distinction between charged and discharged areas is thus lost. Thus, some of the effects which may indicate the development of LCM film include blurring of the image and the loss of fine lines and details in the final print. Because the imaging process lays toner on the belt during operation, an LCM artifact may also resemble a negative image of a previous image which was printed on the photoreceptor, commonly referred to as ghosting.

In one embodiment, the artifact is identified by an operator who determines that an LCM wash should be carried out. Alternatively, the initiation of an LCM wash is carried out by the imaging device, for example, at predetermined time intervals or after a predetermined number of print copies have been generated. In yet another embodiment, the imaging device is programmed to detect the development of LCM film, for example, by evaluating a half tone or non-imaged region of a print formed after a test image has been made which is expected to create artifacts when LCM film is present.

The LCM wash process includes applying a wash liquid to the photoreceptor belt 10A to remove, either partially or completely, LCM film or components thereof from the surface 14 of the belt. In one embodiment, the LCM residue comprising the film is reduced to a level at which artifacts caused by the LCM film are not visible or do not appreciably impair the print quality. The wash liquid includes one or more solvents capable of dissolving, dislodging, or otherwise removing the LCM film, or components thereof, from the surface of the photoreceptor belt.

In one embodiment, the wash liquid includes water. Salts, such as mopholine-derived salts and ammonia-derived salts tend to be water soluble. To improve the rate of drying of the surface treated with the wash liquid, the water may be combined with a fugitive organic material. Suitable fugitive organic materials are those which are liquid at ambient temperatures (i.e., in the range of about 15° C. to about 35° C.), but which are more volatile than water. Additionally, the fugitive material is preferably one which does not tend to leave a residue on the belt after the cleaning process is complete or cause damage to the belt. Suitable fugitive organic materials include $C_1$–$C_6$ alcohols, aldehydes, ketones, alkanes, combinations thereof, and the like. Exemplary alcohols include methanol, ethanol, n-propanol, propan-2-ol (also known as isopropanol or isopropyl alcohol), n-butanol, butan-2-ol, and the like, alone or in combination. Isopropyl alcohol has been found to be particularly effective in removal of morpholine-derived LCM films.

Fugitive organic materials, such as those described above, may also be used in a wash liquid without water, for example, where the LCM film is soluble therein.

In one embodiment, the wash liquid includes water and isopropyl alcohol, alone or in combination with other solvents. For example, a wash liquid suitable for removing morpholine and similar residues comprises from 1–99% by volume isopropyl alcohol (or other fugitive organic material) and 99–1 vol. % water. In a further embodiment, the water is present at a concentration of at least 5 vol. %, in another embodiment, the wash liquid comprises at least 10 vol. % water, and in yet another embodiment at least 20 vol. % water. In one embodiment, the water concentration is less than 60 vol. %, in another embodiment, less than 50 vol. %, and in yet another embodiment, less than 40 vol. %. In one embodiment, the isopropyl alcohol is present in the wash at a concentration of at least 40 vol. %, and in another embodiment, the isopropyl alcohol concentration is at least 50 vol. %, and in yet another embodiment, at least 60 vol. %. For example, one wash composition comprises about 70% alcohol and about 30% water. The concentration of the various components of the wash liquid may depend, to some degree, on the resistance of the photoreceptor belt to degradation by the components and on the effects of residual water on the image quality. A 70/30 mixture of isopropyl alcohol and water was found to reduce the impact of the isopropyl alcohol on the belt used in a XeroX™ Docu Color iGen3™ imaging device while minimizing the effects of low water evaporation on subsequent images formed using the photoreceptor belt. The optimum ratio of alcohol to water may vary, however, for example, depending on the composition of the photoreceptor belt, toner materials, ambient temperature, alcohol used and the like.

The water used to form the wash liquid can be deionized, distilled, or other water which is low in impurities. The alcohol can also be of high purity, such as 98% purity, 99% purity, or greater.

The wash liquid may be applied with a carrier material. For example, a carrier material is soaked in the wash liquid and brought into contact with the photoreceptor belt. Suitable carrier materials include, foams, woven and non woven cloth, pads, and the like. Cleaning of the photoreceptor belt can be carried out manually or by an automated or semi-automated process in which the carrier material is brought into contact with the photoreceptor belt and held in contact while the belt rotates by one or more, preferably several complete revolutions.

Figure 3:
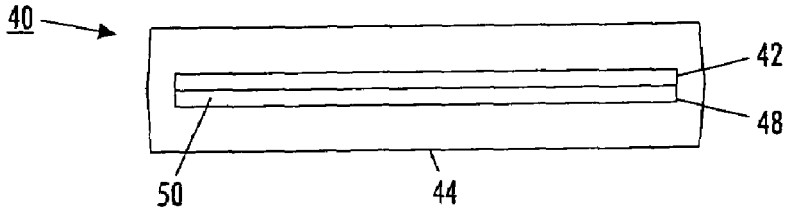
FIG. 3 is a side view of a packaged wash kit according to the present disclosure.
Figure 4:
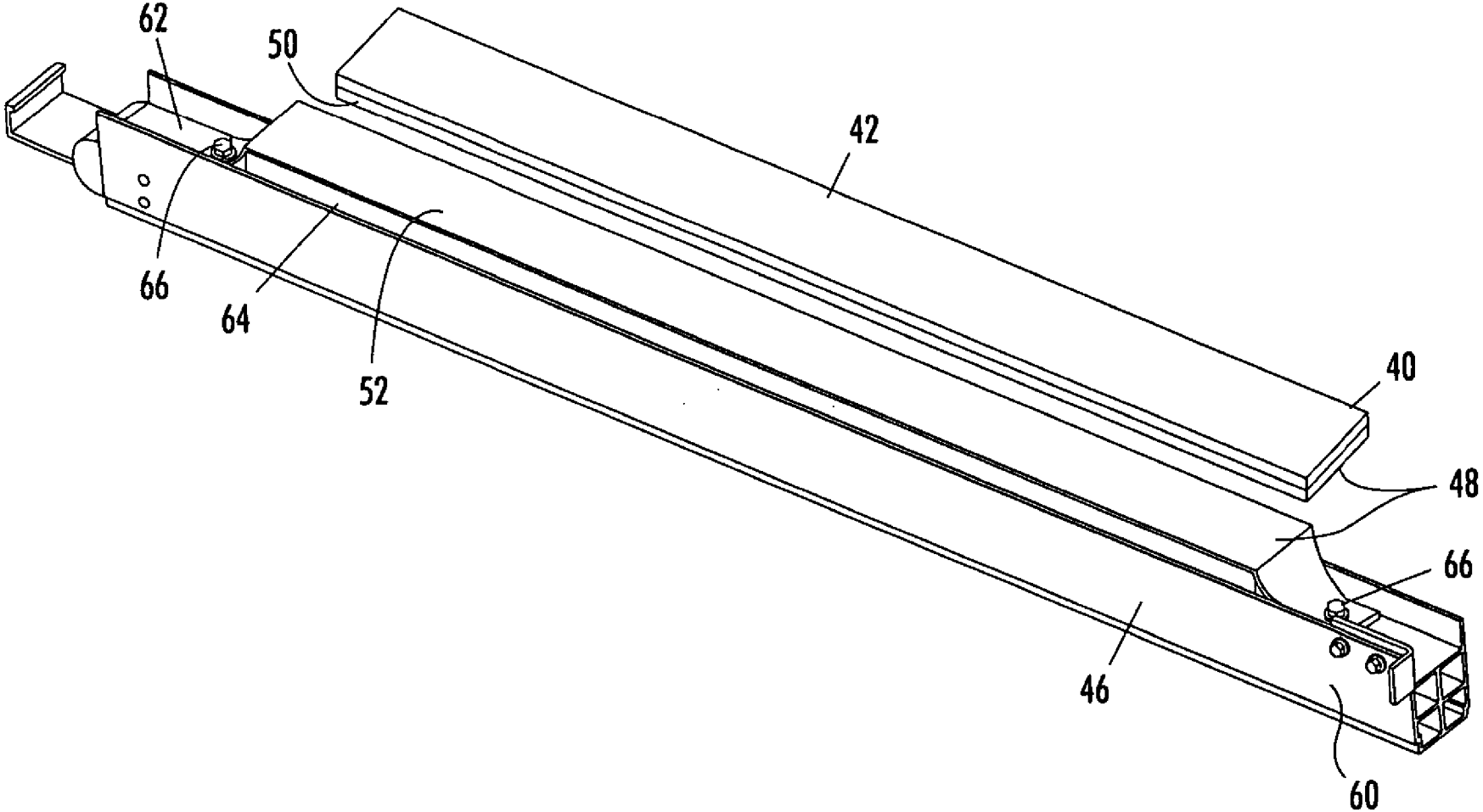
FIG. 4 is a perspective view of a wash kit positioned for mounting on an applicator device according to the present disclosure.
Figure 5:
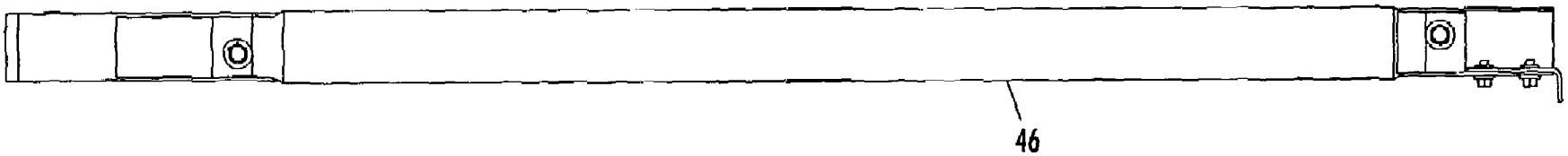
FIG. 5 is an enlarged end top plan view of the application device of FIG. 4.
Figure 6:
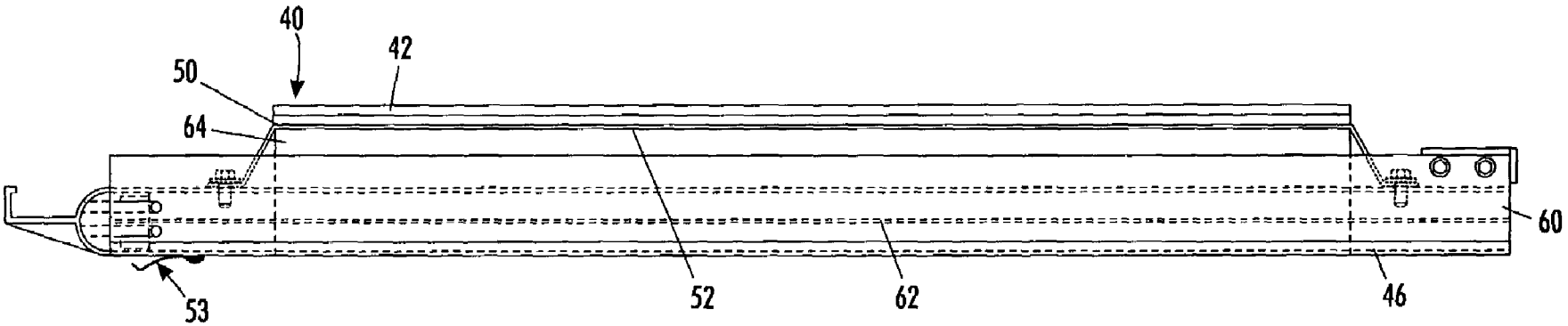
FIG. 6 is a side sectional view of the wash kit and applicator device of FIG. 4 in an assembled position.

With reference now to FIG. 3, in one embodiment, a wash kit 40 comprises a layer of a carrier material 42 in the form of a pad, or the like which carries a predetermined quantity of the wash liquid. The material for the pad is selected to retain an adequate amount of the wash liquid, without releasing it too quickly when pressed against the photoreceptor belt. The pad can be formed from a non-woven felt, a woven cloth, or a foam material. Polyester microdenier needlefelt pads have advantages in that the density and microdenier can be selected so as to retain the low viscosity solution and yet wick it to the belt at an appropriate rate during cleaning. One such material suitable for forming the carrier layer 42 of the pad is available as # MF106PEH from BMP America, Inc. Polyurethane foam, cotton cloths, and the like are also contemplated. The presoaked pad is wrapped, prior to use, in a sealed package 44, which allows the presoaked pad to be shipped and stored without appreciable loss of the solvent. The package 44 may be formed of any suitable material which is substantially impermeable to the wash liquid components. The pad is of a suitable shape and size to span the width of the photoreceptor belt or at least those areas of the belt which are employed for imaging. Prior to use, the soaked pad is removed from its packaging and mounted on an applicator device 46 (FIGS. 4–6). Suitable mounting means 48 allow the presoaked pad to be removably mounted on the applicator device, such as Velcro™ hook and loop strips, adhesive means, hooks, ties, or the like. Hook and loop strips have advantages in that they do not need hardware for attachment to the applicator device which could pose a risk of damage to the photoreceptor belt were the hardware to protrude into the belt plane. In one embodiment, a strip of Velcro™ material 50 is mounted to a rear surface of the pad prior to soaking with the wash liquid. The Velcro™ strip 50 is removably mounted to a complimentary strip 52 of Velcro™ material carried by the applicator device 46.

In a wash liquid application step, the applicator device 46 brings the presoaked pad into contact with the photoreceptor belt. The central processor 38 of the imaging device is programmed to instruct a belt drive system 54 such as a motor, to drive the belt to rotate it a preselected number of rotations or partial rotations. The applicator device 46 applies a sufficient pressure on the pad to maintain contact between the pad and the belt as the belt rotates. The applicator device 46 applies a uniform pressure across the width of the pad while the belt is moving, thereby applying the wash liquid evenly across the surface of the belt. During driving of the belt, the wash liquid on the pad 42, and the slight mechanical action of the pad rubbing against the belt, removes LCM film, or components thereof from the surface of the belt and transfers it to the solvent or otherwise releases the LCM film from the surface in a manner which allows the LCM film to be removed. The dissolved or otherwise treated LCM film may remain on the belt in a layer of the wash liquid and/or be absorbed by the pad during this stage of the cleaning process.

The applicator device 46 may be located at any convenient position around the photoreceptor belt loop. In one embodiment, the applicator device comprises a removable module, which replaces in whole or in part one of the components of the imaging system.

Figure 7:
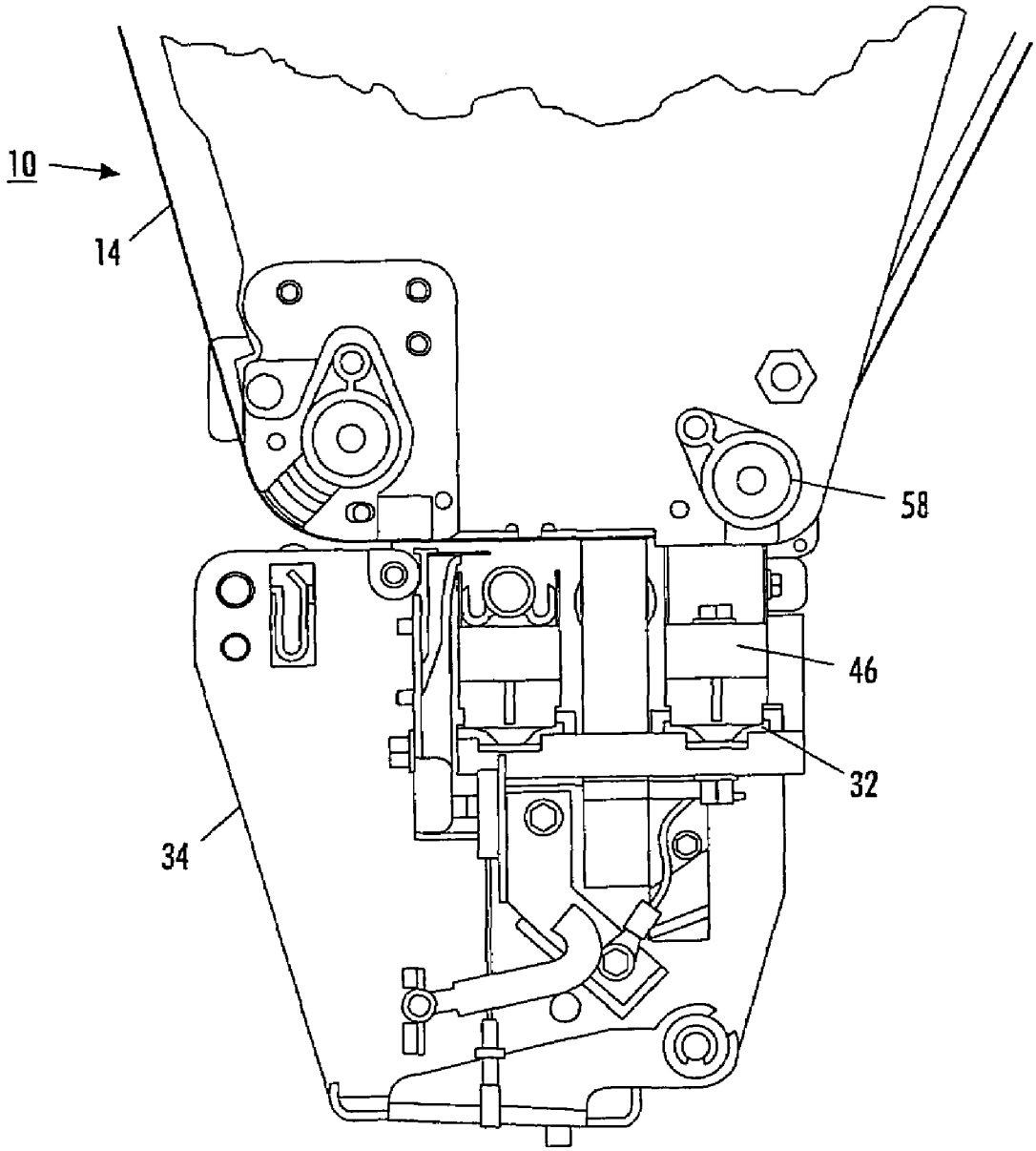
FIG. 7 is an enlarged side sectional view of the lower end of the photoreceptor belt and transfer deck of FIG. 2 with a wash kit and applicator module replacing the detack dicorotron.

For example, as illustrated in FIG. 7, the applicator device 46 comprises a removable module which is configured for replacement of the detack dicorotron 30 (FIG. 2) of the imaging device transfer deck. The transfer deck is lowered and the detack dicorotron is removed from its socket 32. The removable module 46 is positioned in the socket, as shown in FIG. 7. The applicator device 46 includes a hook 53 (FIG. 6), or other suitable engagement portion, for engagement with a suitable latching portion (not shown) in the socket. The transfer deck is then raised and the presoaked pad contacts the belt uniformly. The belt is driven by the drive system 54, under the control of the central processor 38, such that the wash liquid is applied to the entire belt, as discussed above. When the deck is raised, the pad comes into contact with the photoreceptor belt adjacent an assist drive roll 58, which assists in supporting the belt in even contact with the presoaked pad.

With reference to FIGS. 4–6, in this embodiment, the applicator 46 includes an elongate housing 60, formed from metal, plastic, or other rigid material, and similarly shaped to the detack dicorotron 30 which it is to replace. The housing defines an upward opening cavity 62. A biasing element, such as a foam pad 64, is seated in the cavity and extends beyond the housing. The hook and loop material 52 is mounted to the foam pad by a suitable adhesive. Ends of the strip of hook and loop material 52 are attached to the housing 60 with screws 66 or other suitable fixing members. When the presoaked pad 40 is attached to the hook and loop material 52, the foam pad 64 assists in biasing the pad 40 into even contact with the belt, while ensuring that the rigid parts of the housing 60 do not come into contact with the belt. It is also contemplated that the foam pad may form a part of the wash kit, in which case, it may be sandwiched intermediate the pad 40 and the hook and loop material 50 by means of an adhesive or other suitable attachment means.

In another embodiment, all or a portion of one of the charging stations 16M, 16Y, 16C and 16B is removed from the imaging device by an operator and replaced by a dummy charging device in the form of a removable module similar to module 46 on which the presoaked pad is mounted in a similar manner to that described above. By way of example, the removable module is configured for replacing the replaceable portion 17 of the magenta charging station 16M. In the illustrated imaging device, the magenta charging station 16M is furthest from the cleaner 36, due to the layout of the cavity. This allows extra time for the solvent to dry before the belt reaches the cleaner 36. One advantage of positioning the applicator device in one of the charging stations 16M, 16Y, 16C and 16B is that the photoreceptor belt is supported, where the charging station docks, by a respective backer bar 56M, 56Y, 56C and 56B, which promotes a uniform pressure of the solvent soaked pad 42 onto the photoreceptor belt 10A. As with the embodiment shown in FIG. 4, the wash kit may include a presoaked pad which is removably mounted to the applicator module with suitable mounting means, such as a Velcro™ strip.

In yet another embodiment (not illustrated), the applicator device comprises a dedicated wash station, which brings the presoaked pad into contact with the photoreceptor belt 10A while applying a pressure to the pad to maintain contact with the photoreceptor belt throughout one or more revolutions of the belt. The dedicated wash station may be installed permanently in the imaging device and brought into an application position under the control of the central processor 38.

The available drying time for the treated photoreceptor belt can vary considerably, depending on the distance of the module 46 from the cleaner 36. Thus, the preferred ratio of water to solvent to allow for a sufficient drying of the photoreceptor belt is dependent, to some degree, upon the architecture of the system, as well as on the choice of solvent. For example, where the module is located close to the cleaner, such as in the transfer detack dicorotron location, a higher proportion of isopropyl alcohol may be appropriate than what would be suitable for a module located in the magenta charging location.

While a presoaked and prepackaged pad 42 facilitates application of a uniform film of the wash liquid to the photoreceptor belt, it is also contemplated that in place of a presoaked pad, the wash liquid may alternatively be applied to the pad either shortly before mounting to the module 46, or after applying the pad to the module.

Once the wash step is complete, the dummy module 46, or other wash liquid applying means, may be removed from the imaging device or otherwise disengaged from the photoreceptor belt. The dummy module is replaced with the original component of the imaging system (e.g., charging station 16M, dicorotron 30, or portion thereof) which was removed during the wash step.

The wash liquid removal step may alternatively or additionally comprise applying an absorbent material to the belt and removing the absorbent material therefrom. The absorbent material can comprise absorbent particles, such as an inert inorganic material. For example, the absorbent material may comprise toner which is normally used in forming a print. In one embodiment, after the wash liquid application step, the central processor 38 stops the drive system 54 of the photoreceptor belt. The soaked pad 42 and optionally its module 46 are then removed from the imaging system. The central processor 38 then initiates a laying down of toner on the surface of the belt as the belt is driven, for example, by activating one or more of the charging stations 16M, 16Y, 16M, and 16B, and one or more of the developing stations 20M, 20Y, 20M, and 20B. In one embodiment, the charge is applied such that the entire imaging portion of the belt is treated with the toner. The applied toner is optionally transferred to paper, which is then discarded. After one or more revolutions of the belt, the belt is optionally cleaned of any non transferred toner by the cleaning station 36. In some cases, the toner application step may reduce the onset of development of LCM film on the cleaned belt.

The photoreceptor belt 10A is thereby cleaned of LCM film residue and is ready for use in subsequent imaging processes. By using a semi-automated process, such as that described above, in which a presoaked pad 42 is removed from packaging, applied to a replaceable module 46, and inserted into the image device, the entire cleaning process can be completed in about 15 minutes or less, typically, in about 10 minutes. This significantly reduces the downtime of the imaging device, as compared with a belt replacement, which typically takes at least about 45 minutes to complete.

The toner employed in the toner wash step can include one or more of the toner materials used in a conventional imaging process. For example, the toner is applied by one or more of the toner developing stations 20M, 20Y, 20C, and 20B. In practice, a magenta toner wash has been found to result in a more uniform half tone than a black toner wash. While not fully understood, it is suggested that this difference may be due to the chemical makeup of the respective toners, the contact time prior to removal at the cleaning station, or the charge/recharge process that the toner goes through at each charge and recharge station. In the illustrated imaging device, the magenta toner goes through the charge/recharge process of each of the other colors before reaching the cleaner.

The toner wash may comprise any suitable toner material. Toners generally comprise particles of an inert inorganic material and toner particles. The toner particles generally comprise a binder resin and a colorant. Examples of the binder resin include homopolymers and copolymers of the following: styrene compounds, such as styrene and chlorostyrene; monoolefins, such as ethylene, propylene, butylene and isoprene, vinyl esters, such as vinyl acetate, vinyl propionate, vinyl benzoate and vinyl butyrate, α-methylene aliphatic monocarboxylates, such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers, such as vinyl methyl ether, vinyl ethyl ether and vinyl butyl ether, and vinyl ketones, such as vinyl methyl ketone, vinyl hexyl ketone and vinyl isopropenyl ketone. In particular, representative examples of the binder resin include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, and polypropylene. Other exemplary binders include polyesters, polyurethanes, epoxy resins, silicone resins, polyamides, modified rosin, and paraffin waxes.

Representative examples of the colorant include magnetic powder, such as magnetite and ferrite, carbon black, Aniline Blue, Calco Oil Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 12, C.I. Pigment Yellow 17, C.I. Pigment Yellow 97, C.I. Pigment Yellow 128, C.I. Pigment Yellow 151, C.I. Pigment Yellow 155, C.I. Pigment Yellow 173, C.I. Pigment Yellow 180, C.I. Pigment Yellow 185, C.I. Pigment Blue 15:1 and C.I. Pigment Blue 15:3.

Known additives, such as a charge controlling agent, a releasing agent and other inorganic particles, may be added to the toner parent particles through an internal addition treatment or an external addition treatment, as is known in the art.

Representative examples of the releasing agent include low molecular weight polyethylene, low molecular weight polypropylene, Fischer-Tropsch wax, montan wax, carnauba wax, rice wax and candelilla wax.

The charge controlling agent may be known products, and an azo metallic complex compound, a metallic complex compound of salicylic acid and a resin type charge controlling agent containing a polar group may be used.

As the inorganic particles, one or more of silica, alumina, titania, metatitanic acid, zinc oxide, zirconia, magnesia, calcium carbonate, magnesium carbonate, calcium phosphate, cerium oxide, and strontium titanate may be employed. The inorganic particles may include particles of a small diameter and may be subjected to a surface treatment, such as a hydrophobic treatment with a halogenated silane, such as methyltrichlorosilane, to improve the dispersibility and to improve the flowability of the toner. Spherical silica is often used from the standpoint of dispersibility. Particles having an average primary particle diameter of about 80 to 300 nm and a spherical shape may be employed. Amounts of smaller or larger average diameter particles (e.g., particles in the 5 to 50 nm range) may be incorporated to improve flowability. As the particles having such functions, titanium oxide Is particularly effective for suppression of the temperature and humidity dependence of the charge amount of the toner.

The electrophotographic toner can be obtained by mixing the toner particles and the inorganic particles. The process for mixing (blending) is not particularly limited, and known processes can be employed.

A carrier material may also be present in or used in association with the toner. Examples of the carrier include iron powder, glass beads, ferrite powder, nickel powder and powder formed by coating a resin on the surface of the powder.

While it is convenient to use a toner wash to remove residual wash liquid from the photoreceptor belt, it will be appreciated that the "toner" used in the toner wash step need not include all of the ingredients found in a conventional toner as long as the residual wash liquid is removed to a level that subsequent print quality is not unduly impaired.

The cleaning station 36 may comprise an electrostatic cleaning device. Electrostatic cleaning devices employed on automatic xerographic devices typically utilize a brush (not shown) with soft conductive fiber bristles or with insulative soft bristles which have suitable triboelectric characteristics. While the bristles are soft for the insulative brush, they provide sufficient mechanical force to dislodge residual toner particles from the charge retentive surface 14. In the case of the conductive brush, the brush is usually electrically biased to provide an electrostatic force for toner detachment from the charge retentive surface. The accumulated toner is removed from these types of cleaner brushes with a brush cleaner, such as a flicker bar (not shown).

U.S. Pat. No. 6,144,834 (Thayer), which is incorporated herein in its entirety by reference, discloses another embodiment of an electrostatic cleaner which may be used with the present system. FIG. 2 of the '834 patent shows a dual polarity electrostatic cleaner which comprises a transfer belt, carried by rollers, which moves in a direction opposed to that of the photoreceptor belt. Two of the rollers support the transfer belt in brushing contact with the photoreceptor belt, while a third, smaller roller forms a detoning nip with an electrostatic detoning roll. The transfer belt comprises a continuous loop of conductive backing material, e.g., a piezoelectric polymer film, such as polyvinylidene fluoride (PVDF), to which conductive brush fibers are attached.

The following examples describe exemplary embodiments of the present disclosure. These examples are merely illustrative, and in no way limit the present development to the specific materials, conditions or process parameters set forth therein. All parts and percentages are by volume unless otherwise indicated.

EXAMPLES

Cleaning tests are carried out using a pad soaked with a wash liquid. The wash liquid comprised isopropyl alcohol at varying concentration levels. The presoaked pad is fitted to a dummy module used to replace the detack dicorotron of a Xerox iGen printer similar to that illustrated in FIG. 1. After a wash step, toner is applied and removed with the electrostatic cleaner of the printer, fitted with a spots blade. The quality of prints formed subsequent to the cleaning step is examined. The printer was run to form prints. After a cleaning process performed with 100% isopropyl alcohol a slight spots band is observed. After a 34% isopropyl alcohol/66% distilled water wash, slight deposits of tacky material are observed on the spots blade. Prints formed after a 70% isopropyl alcohol/30% distilled water or 50% isopropyl alcohol/50% distilled water wash do not exhibit either of these print quality factors.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A method for removing a residue from an imaging member comprising:

contacting at least a portion of the imaging member with a wash liquid capable of removing the residue from the imaging member; and removing the wash liquid contaminated with residue by applying an absorbent material to the contacted portion of the imaging member;

wherein the absorbent material includes toner.

2. A method for removing a residue from an imaging member comprising:

contacting at least a portion of the imaging member with a wash liquid capable of removing the residue from the imaging member;

removing the wash liquid contaminated with residue by applying an absorbent material to the contacted portion of the imaging member; and removing at least a portion of the applied absorbent material and contaminated wash liquid associated with the absorbent material with an electrostatic cleaner.

3. A method for removing a residue from an imaging member comprising:

contacting at least a portion of the imaging member with a wash liquid capable of removing the residue from the imaging member; and removing the wash liquid contaminated with residue from the imaging member, wherein the residue comprises reaction products of corona effluents with volatile organic chemicals.

4. The method of claim 3, wherein the residue comprises morpholine and the wash liquid comprises a solvent for morpholine.

5. A method for removing a residue from an imaging member comprising:

mounting a pad on a removable module, wherein the pad is presoaked with a wash liquid capable of removing the residue from the imaging member;

docking the removable module in a selected location adjacent the imaging member;

contacting at least a portion of the imaging member with the presoaked pad;

driving the imaging member while the presoaked pad is in contact with the imaging member; and removing the wash liquid contaminated with residue from the imaging member;

wherein the module is configured for removably replacing a component of an imaging device which incorporates the imaging member and docking of the module includes replacing the component with the module.

6. The method of claim 5, wherein the component includes at least one of at least a portion of a transfer deck and at least a portion of a charging station.

7. A system for removing residue from a substrate comprising:

a pad;

a wash liquid carried by the pad;

a module configured for mounting adjacent the substrate for contacting the substrate with the pad whereby the residue is brought into contact with the wash liquid; and means associated with the pad for removably mounting the pad to the module;

wherein the module is configured for removably replacing one of a corona generator and a charging station of an associated imaging system for forming latent images on the substrate.

8. An imaging system comprising:

an imaging member;

means for forming a latent image on the imaging member;

means for transferring the latent image to a transfer material;

means for driving the imaging member relative to the forming and transferring means; and a cleaning module capable of replacing at least a portion of the forming and transferring means, the cleaning module comprising a carrier material soaked with a wash liquid, whereby when the means for driving drives the imaging member, the wash liquid removes residue from the imaging member, the residue being formed during forming of a latent image.

9. The imaging system of claim 8, wherein the imaging member comprises a photoreceptor belt.

10. The imaging system of claim 8, wherein the means for forming a latent image comprises at least one charging station for charging the imaging member prior to forming a latent image, at least a portion of the charging station being in the form of a removable module; and the cleaning module is configured for selectively replacing the module of the charging station.

11. The imaging system of claim 8, wherein the means for transferring the latent image includes a removable module comprising a corona generating device and wherein the cleaning module is configured for selectively replacing the removable module comprising the corona generating device.

12. A method for cleaning a substrate surface contaminated with a morpholine deposit comprising:

contacting the substrate with water and an alcohol to remove the morpholine deposit and, thereafter, contacting the substrate with a toner to absorb the water, alcohol, and removed morpholine deposit.

13. A method for imaging comprising:

forming images on an imaging member;

transferring the images to transfer media, wherein the formation of the images results in a residue being formed on the imaging member which reduces the quality of the transferred image;

contacting the imaging member with a wash liquid to remove residue; and applying a toner composition to the imaging member to remove the wash liquid and residue from the imaging member.

* * * * *